United States Patent [19]

Sidvers et al.

[11] Patent Number: 4,650,357

[45] Date of Patent: Mar. 17, 1987

[54] UNIVERSAL RIBBON CARTRIDGE

[75] Inventors: John Sidvers, Pleasanton; James G. Hume, San Ramon, both of Calif.

[73] Assignee: Xerox Corporation, Stamford, Conn.

[21] Appl. No.: 599,377

[22] Filed: Apr. 12, 1984

[51] Int. Cl.[4] ..... B41J 32/00

[52] U.S. Cl. ..... 400/208; 400/235.1; 400/243

[58] Field of Search ..... 400/194, 195, 196, 196.1, 400/207, 208, 208.1, 229, 234, 235.1, 243

[56] References Cited

U.S. PATENT DOCUMENTS

| | | | |
|---|---|---|---|
| 4,079,827 | 3/1978 | Work | 400/234 |
| 4,252,450 | 2/1981 | Goodman et al. | 400/208 |
| 4,299,504 | 11/1981 | Benz et al. | 400/208 |
| 4,307,969 | 12/1981 | Daughters | 400/208 |
| 4,317,636 | 3/1982 | Hume | 400/208 |
| 4,373,824 | 2/1983 | Olsen | 400/234 |
| 4,400,103 | 8/1983 | Daughters | 400/208 |
| 4,401,394 | 8/1983 | Hume et al. | 400/208 |
| 4,428,695 | 1/1984 | Jamieson | 400/208 X |

*Primary Examiner*—Ernest T. Wright, Jr.

*Attorney, Agent, or Firm*—Richard A. Tomlin; Serge Abend

[57] ABSTRACT

A ribbon take-up drive mechanism for a universal ribbon cartridge. The cartridge is adapted to engage the ribbon drive shafts of printers of two different designs. The drive shaft positions are different, and the direction of drive shaft rotation is opposite for the two designs. The take-up mechanism is designed such that the ribbon is pinched between the teeth of a direct drive gear and a biased idler gear. The printer of one design drives the ribbon through the direct drive gear. The printer of the second design drives the ribbon through an alternate drive gear, an idler gear and the biased idler gear. In either case, the ribbon is advanced in the same direction.

2 Claims, 9 Drawing Figures

UNIVERSAL RIBBON CARTRIDGE

This invention relates to a ribbon cartridge for a printer. The cartridge can be used on the following daisy wheel printers: the Diablo Hy-Type printers, the Diablo 630 printers and the printers for the Xerox 800, 850 and 860 Information Processors.

SUMMARY OF THE PRIOR ART

The above printers and information processors use a daisy wheel printer wherein a daisy wheel and a ribbon cartridge are mounted on a scanning carriage which moves the daisy wheel and ribbon cartridge parallel to a platen against which printing occurs. As is well known, the carriage includes means for mounting and rotating the daisy wheel and means for mounting and incrementing the typing ribbon. Because of design considerations, the ribbon drive shaft location for the Diablo Hy-Type printers and the Diablo 630 printer differs from that of the location of the drive shaft for the printers for the Xerox 800, 850 and 860 Information Processors. Also, the direction of rotation of the drive shafts for the printers and the printers for the information processors is the opposite. One apparatus for accommodating two differing drive shaft locations and opposite direction rotation is disclosed in U.S. Pat. No. 4,307,969. However, this apparatus is not as efficient for operation with a printer having limited drive shaft torque availability as the present cartridge.

BRIEF SUMMARY OF THE INVENTION

The invention as claimed is intended to provide a remedy. The invention provides a more efficient drive for the printers where ribbon drive torque availability is more limited compared to the information processors.

The above advantage and others will become apparent upon reading the specification and particularly when taken in conjunction with the drawing wherein:

DETAILED DESCRIPTION OF THE INVENTION

Figure 1:
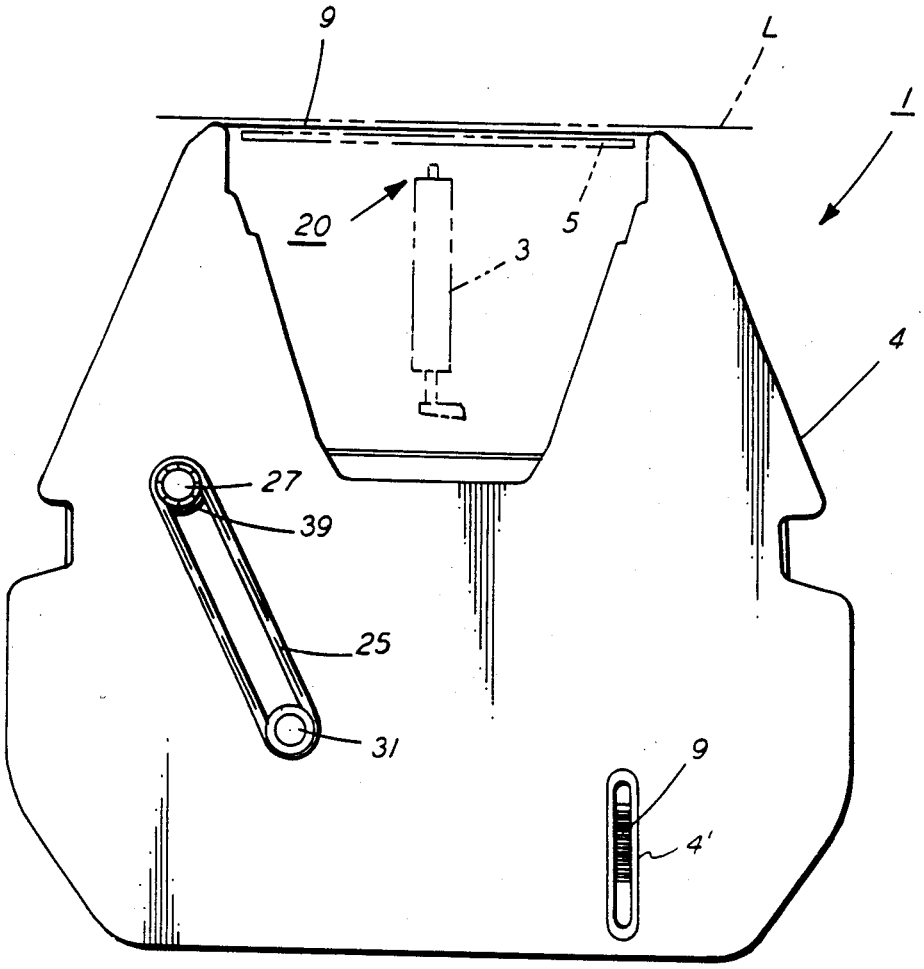
FIG. 1 is a top plan view of a ribbon cartridge in accordance with this invention and also showing its relationship to a daisy wheel type element and print hammer, both shown in broken line.

Referring now to FIG. 1, there is shown a ribbon cartridge generally designated 1. A printer hammer 3, daisy wheel type element 5 and line of typing L are shown in broken line to show the relationship between the ribbon cartridge 1 and those elements.

Figure 3:
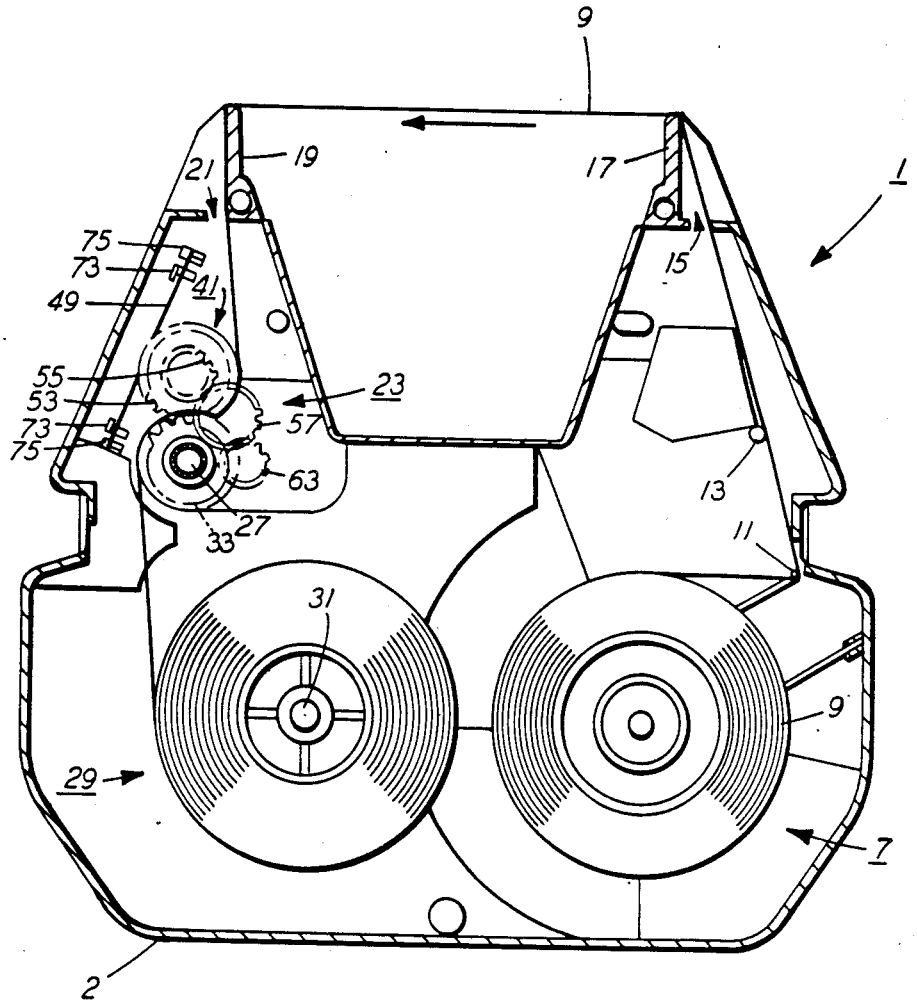
FIG. 3 is a top sectional view of the ribbon cartridge of this invention.

Referring now to FIGS. 1 and 3, there is shown a ribbon supply spool generally designated 7 on which typewriter ribbon 9 is wound. From supply spool 7, ribbon 9 is directed by pins 11, 13 to ribbon exit 15. Ribbon 9 is directed by ribbon guides 17, 19 across the printing station 20, defined by print hammer 3 and daisy wheel 5, and back into ribbon cartridge 1 through ribbon entrance 21. A ribbon take-up drive mechanism generally designated 23 is provided to incrementally pull the ribbon 9 from supply spool 7 across the printing station 20 and back into the ribbon cartridge 1. The ribbon 9 is wound around ribbon take-up spool generally designated 29. Further, a rubber O-ring 25, connected to the ribbon take-up drive mechanism direct drive shaft 27 and take-up spool drive shaft 31, provides drive to ribbon take-up spool 29. An elongated opening 4', formed in the ribbon cartridge cover 4', allows the operator to view the amount of ribbon remaining on the supply spool 7.

Figure 4:
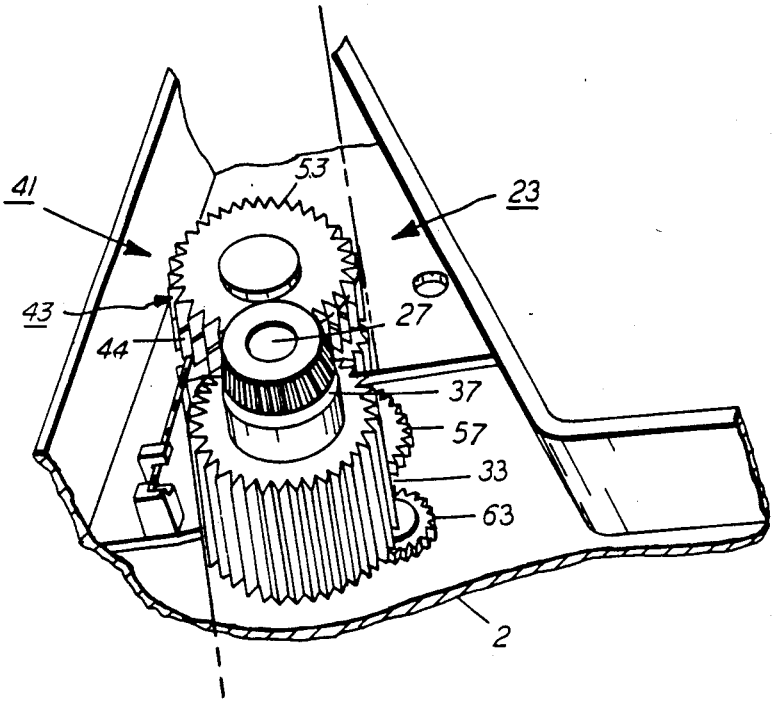
FIG. 4 is a perspective view of the ribbon take-up drive mechanism of this invention.
Figure 5:
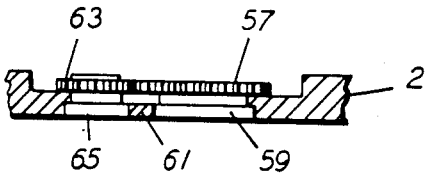
FIG. 5 is a side view in partial section showing the alternate drive shaft gear and an idler gear in accordance with this invention.
Figure 7:
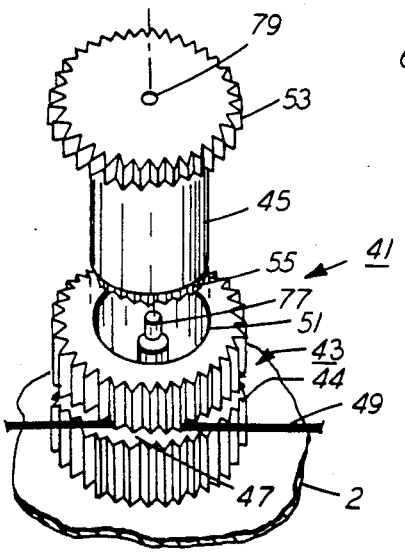
FIG. 7 shows the details of assembly of the biased idler gear and biasing member of the drive mechanism of this invention.
Figure 8:
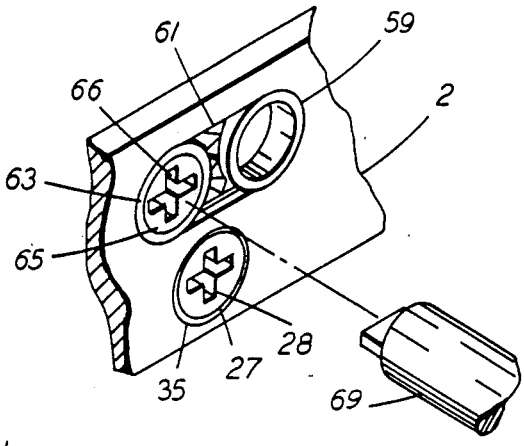
FIG. 8 is a perspective view showing the manner of engagement between the alternate drive gear and drive shaft for the information processor printers.
Figure 9:
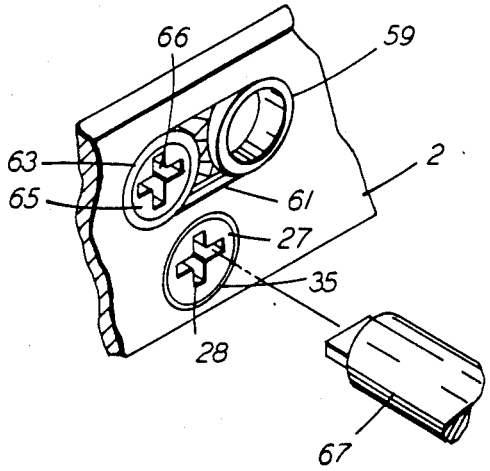
FIG. 9 is a perspective view showing the manner of engagement between the direct drive gear and drift shaft for the Diablo printers.

Referring now to FIGS. 3, 4, and 5, ribbon take-up drive mechanism 23 is made up of two drive gears, an alternate drive gear and a direct drive gear, and two idler gears, one of the idler gears being biased into contact with the direct drive gear. Direct drive gear 33, along with all other gears and ribbon spools, is mounted for rotation on ribbon cartridge base 2. The drive shaft 27 of direct drive gear 33 is inserted for rotational movement into aperture 35 (see FIGS. 2, 8 and 9). Direct drive gear 33 has a recessed channel 37 (see FIG. 4) in its periphery in which O-ring 25 (see FIG. 1) rides. Direct drive gear 33 is held in place for rotation by aperture 35 in ribbon cartridge base 2 (see FIG. 2) and aperture 39 in ribbon cartridge cover 4 (see FIG. 1). Ribbon 9 passes between direct drive gear 33 and mating biased idler gear generally designated 41. As can best be seen in FIG. 7, biased idler gear 41 is formed in two sections, an outer section 43 and an inner section 45. Outer section 43 has a groove 47 in its periphery to accommodate spring bias wire 49. Outer section 43 has a central cavity 51 into which inner section 45 slides. Inner section 45 has formed thereon a first set of gear teeth 53, which match gear teeth 44 on outer section 43, and a second set of gear teeth 55, which, when inner section 45 is pushed into outer section 43, mesh with idler gear 57. The shaft 59 of idler gear 57 is press fit into elongate aperture 61 in ribbon cartridge base 2 along with alternate drive gear 63. As best seen in FIGS. 2, 5, 8 and 9, alternate drive gear 63 is mounted by means of its drive shaft 65 in elongate aperture 61. The ends of direct drive shaft 27 and alternate drive shaft 65 are provided with recessed slots 28 and 66, respectively. Slot 28 is shaped and located to accommodate the ribbon drive shaft 67 of a first set of printers, and slot 66 is shaped and located to receive the ribbon drive shaft 69 of a second set of printers.

Figure 2:
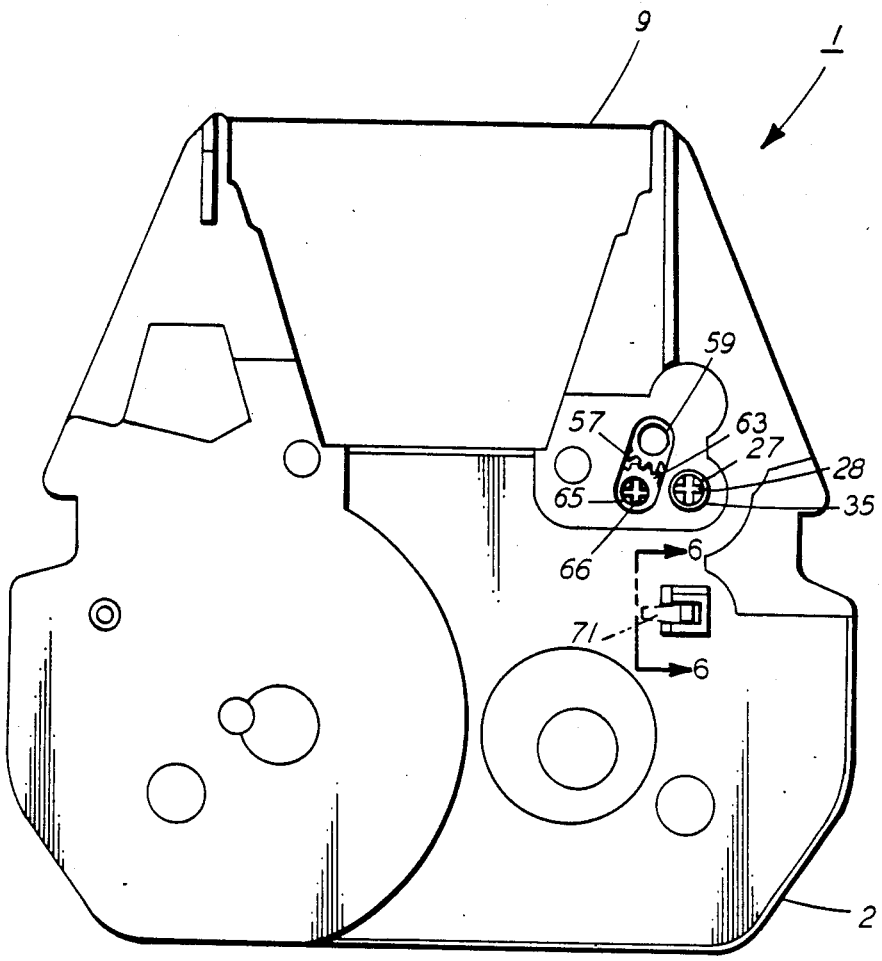
FIG. 2 is a bottom plan view of a ribbon cartridge in accordance with this invention.
Figure 6:
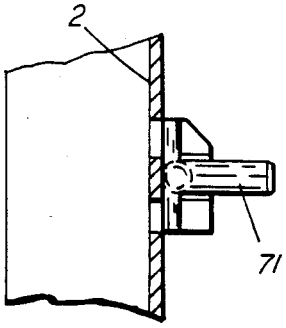
FIG. 6 shows the details of a folding post used for alignment on one type of printer mounted on the ribbon cartridge base, viewed in the direction of section lines 6—6 of FIG. 2.

Referring now to FIGS. 2 and 6, there is shown a post 71, which can lie flat, as shown in dashed line for one set of printers (not shown), and erect, as shown in solid line for the second set of printers (not shown).

Assembly of the ribbon take-up drive mechanism 23 is relatively easy. First, as seen in FIG. 5, alternate drive gear 63 and idler gear 57 are press fit into elongate aperture 61. The contact between the teeth of gears 57, 63 causes shafts 59, 65 to frictionally and rotationally contact the ends of elongate aperture 61. As seen in FIG. 3, biased idler gear bias spring wire 49 is placed in spring retainer clips 73, 75. At the same time and as can best be seen in FIG. 7, outer section 43 is placed loosely over idler gear post 77 so that groove 47 assists in holding idler bias spring wire 49 in place. Idler gear post 77 is formed on cartridge base 2. Inner section 45 of biased idler gear 41 is provided with cylindrical aperture 79, which is shaped to press fit on post 77. As inner section 45 is pushed into outer section 43, outer section 43 is aligned axially with post 77 and is forced into a biasing relationship with idler bias spring wire 49. Biased idler gear 41 is thus biased toward direct drive gear 33, which is set in place in aperture 35 ensuring firm meshing of biased idler gear 41 and direct drive gear 33 and thus a positive contact with ribbon 9, which is threaded between the biased idler gear 41 and direct drive gear 33. Note in FIG. 4 that both the teeth 53 of inner section 45 and the teeth 44 of outer section 43 mesh with direct drive gear 33. The ribbon cartridge is completed by placing the ribbon spools 7, 29, ribbon 9, ribbon cartridge cover 4 and O-ring 25 in place as shown in the Figures.

In operation, when printer drive shaft 69 is in operating contact with alternate drive gear 63, ribbon 9 advance occurs as follows. The incrementation of ribbon 9 is caused by the incremental rotation of alternate drive gear 63 clockwise, as seen in FIG. 3, a predetermined amount. Rotation of alternate drive gear 63 causes counterclockwise rotation of idler gear 57. Idler gear 57 in turn rotates biased idler gear 41 clockwise. Direct drive gear 33 in this case becomes an idler gear driven counterclockwise by biased idler gear 41. Ribbon 9 is pinched between the teeth 44, 53 of biased idler gear 41 and meshing direct drive gear 33 so that as biased idler gear 41 and direct drive gear 33 rotate, ribbon 9 is drawn from supply spool 7. As direct drive gear 33 is rotated counterclockwise, O-ring 25, mounted on direct drive shaft 27 and on take-up roll drive shaft 31, rotates take-up spool 29 counterclockwise, which thus collects ribbon 9. As is well known in the art, O-ring 25 compensates for the increasing diameter of ribbon 9 on take-up spool 29 by slipping.

When a printer having a drift shaft 67 is used, the drive is connected directly to direct drive gear 33. As seen in FIG. 3, direct drive gear 33 is driven counterclockwise by printer ribbon drive shaft 69. As direct drive gear 33 moves counterclockwise, biased idler gear 41 is rotated clockwise, the intermeshing teeth of the two gears, 33, 41 again pulling ribbon 9 from supply spool 7 and collecting it on take-up spool 29. It can be seen that the ribbon take-up drive mechanism 23 of this invention is usable on printers of two different designs where the ribbon drive shaft locations differ and have opposite drive shaft rotation. It can also be seen that the direct drive gear 33 efficiently utilizes the drive torque available. The ribbon take-up drive mechanism 23 is relatively inexpensive to produce and is easy to assemble.

It can be seen that the rate of incrementation of the alternate ribbon drive train may be altered by changing the number of teeth of any one of, or a combination of, alternate drive gear 63, idler gear 57, and gear 55 on biased idler gear inner section 45. Similarly, the rate of incrementation of the direct ribbon drive train may be altered by changing the number of teeth of direct drive gear 33. Thus, the increment of advancement of the ribbon is independently controlled by each gear train.

Although the present invention has been described with reference to a presently preferred embodiment, it will be appreciated by those skilled in the art that various modifications, alternatives and variations may be made without departing from the spirit and scope of the invention as defined in the appended claims.

What is claimed is:

1. A ribbon take-up drive mechanism for use in a ribbon cartridge, the ribbon cartridge to be used on a first printer having a first ribbon drive shaft in a first location, the first ribbon drive shaft being rotated in a first direction in operation, and on a second printer having a second ribbon drive shaft in a second location, the second ribbon drive shaft being rotated in a direction opposite the first direction, said ribbon take-up drive mechanism comprising a first ribbon drive train for use with the first printer including a direct drive gear positioned to be rotated by the first ribbon drive shaft and bearing a first toothed surface; and a biased idler gear bearing a second toothed surface mating with said first toothed surface and biased into rotatable meshing contact with said direct drive gear for advancing ribbon therebetween; and a second ribbon drive train for use with the second printer including an alternative drive gear positioned to be separated from said direct drive gear and to be rotated by the second ribbon drive shaft;

an idler gear positioned in rotatable meshing engagement with said alternate drive gear; and said biased idler gear positioned in rotatable meshing engagement with said idler gear and said direct drive gear, and wherein the increment of advancement of the ribbon is independently controlled by the gear train ratios of each of said first and second ribbon drive trains.

2. The mechanism of claim 1 wherein said biased idler gear is formed of an inner section and an outer section, said inner section being positioned in rotatable meshing engagement with said idler gear for being driven thereby, said inner section being slidable within said outer section which bears said second toothed surface thereon, and said inner section includes a third toothed surface, matching said second toothed surface, for mating with said first toothed surface.

* * * * *